US005429776A

United States Patent [19]

Edlund

[11] Patent Number: 5,429,776

[45] Date of Patent: Jul. 4, 1995

[54] ARRANGEMENT IN AN INTERNAL COMBUSTION ENGINE

[76] Inventor: Dag Edlund, Lackeraregatan 2, S-561 42 Huskvarna, Sweden

[21] Appl. No.: 245,879

[22] Filed: May 19, 1994

[30] Foreign Application Priority Data

Jun. 16, 1993 [SE] Sweden ..... 9302086

[51] Int. Cl.[6] ..... F02M 17/04

[52] U.S. Cl. ..... 261/35; 261/DIG. 68

[58] Field of Search ..... 261/35, DIG. 68

[56] References Cited

U.S. PATENT DOCUMENTS 3,174,732 3/1965 Brown ..... 261/DIG. 68

5,073,307 12/1991 Langer et al. ..... 261/DIG. 68

*Primary Examiner*—Tim Miles

[57] ABSTRACT

An arrangement in an internal combustion engine comprises a membrane carbureter (10) having a fuel chamber (12) provided with a movable membrane (11) cooperating with a valve (17) for controlling the fuel supply to said fuel chamber. The air inlet of the carbureter is connected to a filter housing (31) provided with an air filter (32) for cleaning the inlet air, and a pressure chamber (13) is disposed adjacent said membrane and connected to said filter housing to control the fuel supply in relation to the pressure drop across said air filter (32). According to the invention, the membrane (11) is arranged in parallel with a wall (33) of the filter housing, and said wall is disposed adjacent to the pressure chamber (13) and provided with an opening (34) via which said pressure chamber communicates with the interior of said filter housing.

2 Claims, 1 Drawing Sheet

ARRANGEMENT IN AN INTERNAL COMBUSTION ENGINE

Figure 1:
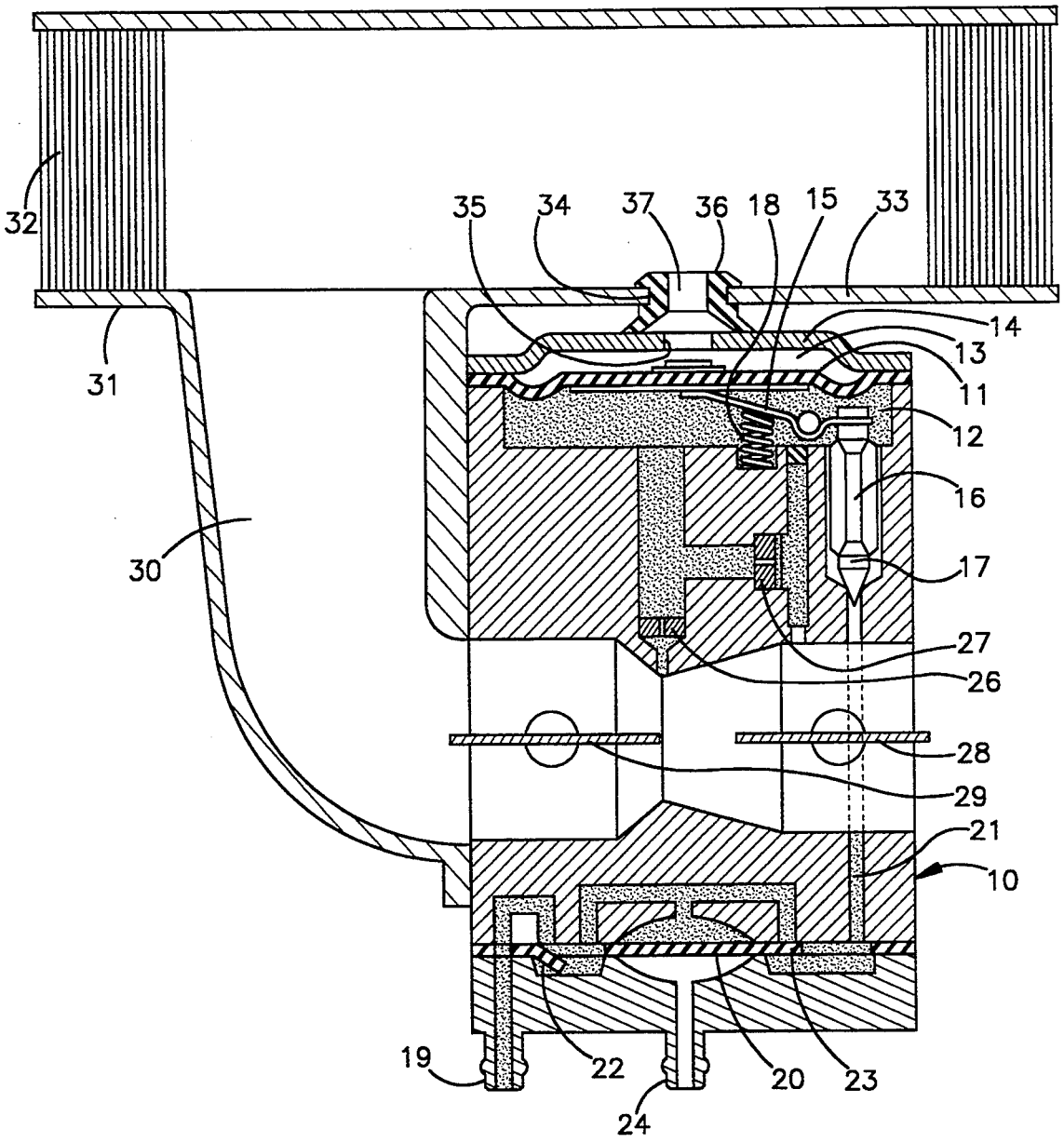

The present invention relates to an arrangement in an internal combustion engine comprising a membrane carbureter having a fuel chamber provided with a movable membrane cooperating with a valve for controlling the fuel supply to said fuel chamber, the air inlet of the carbureter being connected to a filter housing provided with an air filter for cleaning the inlet air, and a pressure chamber disposed adjacent said membrane and connected to said filter housing to control the fuel supply in relation to the pressure drop across said air filter.

As is well known in the field, the pressure drop across the air filter increases with the clogging of the filter by impurities. In engines operating in a dusty environment, as is often the case with chain saws, for example, the filter may be clogged in a relatively short time of operation. The increasing pressure drop has the result that the air/fuel mixture of the engine will be too rich which requires either cleaning of the filter or adjustment of the carbureter. By having the membrane actuated by the pressure in the filter housing, said pressure being in turn related to the speed of rotation of the engine and the pressure drop across the air filter, it is possible, within certain limits, to obtain an automatic adjustment of the air/fuel mixture as the filter is being clogged.

It is known per se to connect the membrane housing to the filter housing to provide said automatic adjustment. In known arrangements for this purpose a hose connected between the membrane housing and the filter housing is used to provide the mentioned connection which will thereby be relatively long and narrow. The present invention provides an arrangement which makes it possible to dispense with said hose and to provide a shorter and more direct connection whereby a simpler construction is obtained, and in addition a reduced delay and more rapid reaction of the automatic adjustment of the carbureter in relation to the pressure in the filter housing.

This has been obtained by means of an arrangement of the kind mentioned in the introduction which according to the invention is characterized in that the membrane is arranged in parallel with a wall of the filter housing, and that said wall is disposed adjacent to the pressure chamber and provided with an opening via which the pressure chamber communicates with the interior of the filter housing.

The invention will be described in more detail in the following with reference to the accompanying drawing which illustrates a section of a preferred embodiment of the arrangement according to the invention.

In the drawing, a carbureter is shown which is particularly intended to be used with a two-stroke engine of a chain saw. The shown carbureter is generally designated 10 and is provided with a movable membrane 11 having a fuel chamber 12 on one side and a pressure chamber 13 delimited by an outer wall 14 on the other side. The membrane 11 is operatively connected via a lever 15 and a bar 16 to a valve 17 controlling the fuel supply to the carbureter. The level 15 is actuated by a spring 18. Fuel is supplied to the valve 17 from a fuel tank (not shown) via a nipple 19, a membrane pump 20, and a passage 21. The membrane pump 20 is provided with one way valves 22, 23 and is actuated by pressure pulses from the crankcase of the engine via a nipple 24. Fuel is supplied from the valve 17 to the chamber 12 and further to a high speed nozzle 26 and a low speed nozzle 27.

The shown carbureter is provided in a conventional way with a gas throttle 28 and a choke valve 29 and is connected via an inlet passage 30 to a filter housing 31 provided with an air filter 32. The filter housing 31 has a wall 33 disposed adjacent to and in parallel with the outer wall 14 of the carbureter. Said walls 33 and 14 have aligned openings 34 and 35, respectively. In the opening 34 an elastic sealing sleeve 36 is inserted which sealingly engages the wall 14 around the opening 35, thereby forming a very short connection 37 between the interior of the filter housing 31 and the chamber 13 at the overside of the membrane 11.

As has been mentioned above, the pressure prevailing in the filter housing 31 is related to the pressure drop across the air filter 32 which in turn is related to the extent of clogging of the filter. As the air filter 32 is clogged, the pressure in the filter housing will be reduced due to the increased pressure drop. This change of pressure is transferred via the connection 37 to the chamber 13 to actuate the membrane 11 whereby the valve 17 is adjusted accordingly. An automatic adjustment of the air/fuel mixture of the engine to the prevailing condition of the air filter is thereby obtained whereby manual adjustment of the carbureter is made unnecessary.

It should be easily realized that the shown arrangement has a very simple and reliable construction, and that the short connection 37 provides a rapid actuation without delay of the membrane 11 and consequently also the valve 17, which enables the engine to operate at the correct air/fuel mixture all the time.

I claim:

1. An arrangement in an internal combustion engine comprising a membrane carbureter (10) having a fuel chamber (12) provided with a movable membrane (11) cooperating with a valve (17) for controlling the fuel supply to said fuel chamber, the air inlet of the carbureter being connected to a filter housing (31) provided with an air filter (32) for cleaning the inlet air, and a pressure chamber (13) disposed adjacent said membrane and connected to said filter housing in order to control the fuel supply in relation to the pressure drop across said air filter (32), characterized in that the membrane (11) is arranged in parallel with a wall (33) of the filter housing, and that said wall is disposed adjacent to the pressure chamber (13) and provided with an opening (34) via which said pressure chamber communicates with the interior of said filter housing.

2. Arrangement according to claim 1, characterized in that the opening (34) is provided with an elastic sealing sleeve (36) sealing around a corresponding opening (35) provided in an adjacent wall (14) of the pressure chamber.

* * * * *

UNITED STATES PATENT AND TRADEMARK OFFICE

CERTIFICATE OF CORRECTION

PATENT NO. : 5,429,776

DATED : July 4, 1995

INVENTOR(S) : Dag Edlund

It is certified that error appears in the above-indentified patent and that said Letters Patent is hereby corrected as shown below:

On the title page, Item [73] the following information should be inserted with respect to the assignee: --Aktiebolaget Electrolux, Stockholm, Sweden--.

Item [30] Foreign Application Priority Date, delete "9302086" and insert --9302086-5--.

Item [56] should be inserted with respect to Attorney, Agent or Firm: --Pearne, Gordon, McCoy & Granger--.

Signed and Sealed this

Twenty-sixth Day of September, 1995

*Attest:*

Bruce Lehman

BRUCE LEHMAN

*Attesting Officer*

*Commissioner of Patents and Trademarks*